US012024864B2

(12) United States Patent
Wang et al.

(10) Patent No.: US 12,024,864 B2
(45) Date of Patent: Jul. 2, 2024

(54) QUICK ASSEMBLY AND QUICK DISASSEMBLY DEVICE FOR FAUCET

(71) Applicant: XIAMEN FENGYI TECHNOLOGY CO., LTD., Xiamen (CN)

(72) Inventors: Jinfa Wang, Xiamen (CN); Binghui Zhu, Xiamen (CN); Xiangsheng Zheng, Xiamen (CN)

(73) Assignee: XIAMEN FENGYI TECHNOLOGY CO., LTD., Xiamen (CN)

( * ) Notice: Subject to any disclaimer, the term of this patent is extended or adjusted under 35 U.S.C. 154(b) by 108 days.

(21) Appl. No.: 17/981,679

(22) Filed: Nov. 7, 2022

(65) Prior Publication Data

US 2023/0075627 A1 Mar. 9, 2023

Related U.S. Application Data

(63) Continuation of application No. PCT/CN2021/132468, filed on Nov. 23, 2021.

(30) Foreign Application Priority Data

Jul. 28, 2021 (CN) ..... 202121738715.9

(51) Int. Cl.
*E03C 1/04* (2006.01)

(52) U.S. Cl.
CPC ..... *E03C 1/0402* (2013.01)

(58) Field of Classification Search
CPC ..... E03C 1/0401; E03C 1/0402
See application file for complete search history.

(56) References Cited

U.S. PATENT DOCUMENTS

| | | | | |
|---|---|---|---|---|
| 9,212,474 | B2 * | 12/2015 | Ye | E03C 1/0401 |
| 10,428,496 | B1 * | 10/2019 | Lu | E03C 1/0403 |
| 10,563,383 | B2 * | 2/2020 | Lu | E03C 1/0401 |
| 10,724,215 | B2 * | 7/2020 | Darocha | E03C 1/0401 |

* cited by examiner

*Primary Examiner* — Erin Deery
(74) *Attorney, Agent, or Firm* — Cooper Legal Group LLC

(57) ABSTRACT

A quick assembly and quick disassembly device for a faucet, configured for fastening of the faucet, comprises a base seat, an upper cover, and at least two locking blocks. The base seat comprises a mounting hole. The upper cover is sleeved outside of the faucet and is detachably connected to the base seat. Each of the at least two locking blocks comprises a first inclined surface pushed by at least two transmission members to enable the at least two locking blocks to move radially inward to abut the faucet. A position-providing notch between two adjacent locking blocks provides a space for a joint of a flexible hose so as to easily mount or detach the faucet. A distal end of the at least two elastic assemblies is disposed in at least two locking blocks to enable the at least two locking blocks to move outward to release the faucet.

10 Claims, 7 Drawing Sheets

QUICK ASSEMBLY AND QUICK DISASSEMBLY DEVICE FOR FAUCET

RELATED APPLICATIONS

This application claims priority to International patent application number PCT/CN2021/132468, filed on Nov. 23, 2021, which claims priority to Chinese patent application number 202121738715.9, filed on Jul. 28, 2021. International patent application number PCT/CN2021/132468 and Chinese patent application number 202121738715.9 are incorporated herein by reference.

FIELD OF THE DISCLOSURE

The present disclosure relates to the field of faucet disassembly and assembly, and in particular to a quick assembly and quick disassembly device for a faucet.

BACKGROUND OF THE DISCLOSURE

The existing faucet use sleeve thread fixation, single screw fixation, double screw fixation, and the like for fixing the existing faucets in place. The more stable method is the sleeve thread fixation, which adopts a ring nut that is locked to achieve fixation of a whole circle of an end face and a rubber ring for fixing. However, due to a narrow installation space under a countertop, the sleeve thread fixation method cannot be operated visually. In addition, a force required for fixed installation is relatively large, and a thread locking length is long, so installation and disassembly are inconvenient and difficult. An adjustable wrench is required (the adjustable wrench cannot be used in many cases when the space is small) or a special plastic Allen wrench is required for enabling the ring nut to be locked in place.

In addition, the existing ordinary plastic nut (i.e., used as the ring nut) cannot withstand a torque requirement of 61 N·m required by international standards. During installation, it is difficult for hexagon nuts of the hot water inlet hose and cold water inlet hose of the faucet to pass through lock nuts (i.e., the ring nut) of a sleeve. The common nuts are M33*1.5 and M32*1.5, and a total diameter of the hexagon nuts and the hoses is required to be 38.5 mm for passing through smoothly. Many products on the market use copper nuts with C-shaped openings. Therefore, in order to ensure sufficient thread length and opening strength, it is necessary to increase the thickness of the C-shaped copper nuts and strength of the material.

The sleeve thread fixation method can only be used for a fixed kind of nut. The nut cannot be used for M32*1.5 thread fixation if the nut is used for M33*1.5 thread fixation, vice versa. Most nuts are made with copper. The cost of metal materials is getting higher and higher, and the cost is high.

Therefore, there are many parts in existing quick-installation methods, the product assembly is complicated, it is difficult to ensure the stability and reliability of the product, and it is impossible to achieve the universality of different threads. The water inlet hose of the domestic faucet adopts G½ nuts, and the hexagonal nut is larger than that of foreign ones. The G⅜ nut cannot be installed quickly, and the toughness of nylon material cannot guarantee its strength as a threaded part. Most of the quick-release structures on the market use deformable plastic for thread locking, which cannot guarantee the strength required for fixing.

BRIEF SUMMARY OF THE DISCLOSURE

The present disclosure provides a quick assembly and quick disassembly device for a faucet to solve the deficiencies of the existing faucet quick-installation parts that have complex product assembly and difficulty in ensuring the stability and reliability of the product. The quick assembly and quick disassembly device has few components, simple structure, convenient disassembly and assembly, and high versatility.

A technical solution of the present disclosure is as follows.

A quick assembly and quick disassembly device for a faucet, configured for fastening of the faucet, comprises a base seat, an upper cover, and at least two locking blocks. The base seat comprises a mounting hole configured for passing through of the faucet, and the upper cover is configured to be sleeved outside of the faucet and is detachably connected to the base seat, The at least two locking blocks are disposed in the base seat and spaced apart from one another along a circumferential direction of the mounting hole, and each of the at least two locking blocks comprises a first inclined surface. The upper cover correspondingly comprises at least two transmission members configured to push the first inclined surface of a corresponding one of the at least two locking blocks to enable the corresponding one of the at least two locking blocks to move inward along a radial direction of the base seat to abut the faucet, and an inner wall of the base seat is disposed with at least two elastic assemblies obliquely extending along the radial direction of the base seat. A distal end of each of the at least two elastic assemblies is disposed in a corresponding one of the at least two locking blocks to enable the corresponding one of the at least two locking blocks to move outward to release the faucet.

Preferably, each of the at least two locking blocks comprises two buckle grooves arranged symmetrically, and the two buckle grooves extends along a circumferential direction or a radial direction of the at least two locking blocks. Each of the at least two elastic assemblies comprises two elastic members arranged symmetrically, and a distal end of each of the two elastic members is disposed in a corresponding one of the two buckle grooves.

Preferably, each of the two buckle grooves comprises an opening located on an outer peripheral wall of the at least two locking blocks and adjacent to a distal end of the at least two locking blocks, and a side of the opening comprises a guiding inclined surface inclined outward.

Preferably, a top portion of the base seat comprises an assembly groove, the at least two locking blocks are disposed in the assembly groove, and the at least two elastic assemblies are disposed on a side wall of the assembly groove.

Preferably, an outer side of each of the at least two locking blocks comprises a supporting surface extending in a direction perpendicular to a moving direction of the at least two locking blocks, the assembly groove is correspondingly disposed with a supporting member, and the supporting member is matched with the supporting surface.

Preferably, each of the at least two locking blocks comprises a sliding surface, and the sliding surface extends in a direction along a moving direction of the at least two locking blocks. The assembly groove is correspondingly disposed with a guiding member, and the guiding member is slidingly matched with the sliding surface.

Preferably, an inner side of each end of each of the at least two locking blocks comprises a notch, and two of the notches of two adjacent locking blocks of the at least two locking blocks define a position-providing notch. Or, the at least two locking blocks are made of plastic.

Preferably, the base seat comprises a first buckle member located adjacent to a top portion of the base seat, and the upper cover comprises a second buckle member that cooperates with the first buckle member to achieve a detachable connection through being locked to the first buckle member.

Preferably, the upper cover comprises a blocking ring, and the at least two locking blocks are disposed between the blocking ring and a bottom of the assembly groove Preferably, the first inclined surface is configured to be located on a top portion of an outside of the at least two locking blocks and inclined upward along the radial direction of the base seat, and an inner side of the least two transmission members comprises a second inclined surface correspondingly matched with the first inclined surface.

Compared with the existing techniques, the technical solution has the following advantages.

1. The device of the present disclosure comprises the base seat, the upper cover, and the at least two locking blocks. The at least two locking blocks are disposed in the base seat. The upper cover correspondingly comprises at least two transmission members configured to push a first inclined surface of a corresponding one of the at least two locking blocks to enable the corresponding one of the at least two locking blocks to move inward along a radial direction of the base seat to abut the faucet, and the base seat is disposed with at least two elastic assemblies to enable the at least two locking blocks to move outward to release the faucet. The device has few parts, simple structure, no need to operate in a visual environment, and high versatility.
2. In the device of the present disclosure, each of the at least two locking blocks comprises two buckle grooves, each of the at least two elastic assemblies comprises two elastic members, and a distal end of each of the two elastic members is disposed in a corresponding one of the two buckle grooves. The two elastic members are capable of deformation, and springs and elastic rings are omitted.
3. In the device of the present disclosure, the outer side of each of the at least two locking blocks comprises the supporting surface, and the assembly groove is correspondingly disposed with the supporting member matched with the supporting surface. The supporting surface is configured to abut the supporting member to have a position-limiting function. The supporting member is configured to support the at least two transmission members when the at least two transmission members push the at least two locking blocks, which prevents the at least two transmission members from deformation. The greater a locking force, the greater a holding force of the at least two locking blocks, and the faucet is locked to the greatest extent.
4. In the device of the present disclosure, each of the at least two locking blocks comprises the sliding surface. The assembly groove is correspondingly disposed with the guiding member slidingly matched with the sliding surface. When the at least two locking blocks move inward or move outward in the radial direction of the base seat, the sliding surface slides along the guiding member so that the guiding member has a guiding function.
5. In the device of the present disclosure, there is the gap between the edge of the top of the upper cover and the top surface of the base seat. When the at least two locking blocks tightly abut the threaded tube of the faucet, the gap allows the at least two locking blocks to lock the threaded tube of the faucet with different threads. A locking height of the base seat can be adjusted according to a thread size of the threaded tube. The aforementioned arrangement can meet the locking requirements of different threaded tubes and has high versatility.
6. In the device of the present disclosure, the inner side of each end of each of the at least two locking blocks comprises the notch, and two of the notches of the two adjacent locking blocks define the position-providing notch configured to provide a space for a joint of a flexible water inlet pipe to pass through. The faucet can be installed or removed directly without removing the joint.
7. In the device of the present disclosure, the at least two locking blocks can be made of high-temperature modified rigid plastic with strong rigidity, which ensures the locking strength and stability. The base seat and the upper cover can be made of conventional plastic materials, such as ordinary polyoxymethylene (POM) material, thereby reducing the overall cost, simplifying the structure, and making the assembly more convenient.

Figure 1:
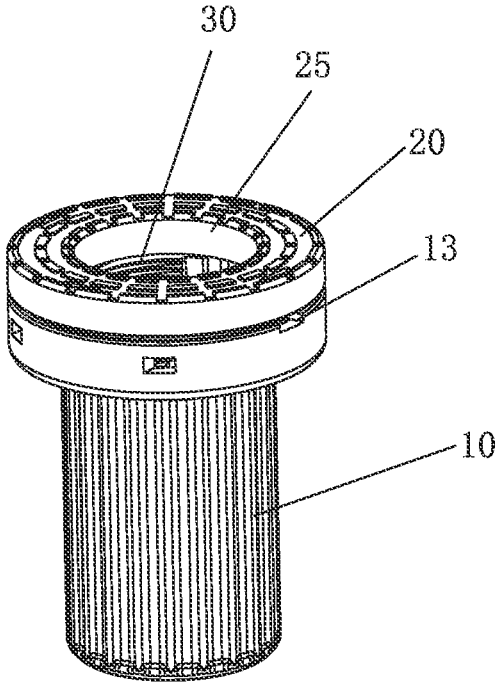
FIG. 1 illustrates a perspective view of the present disclosure.
Figure 2:
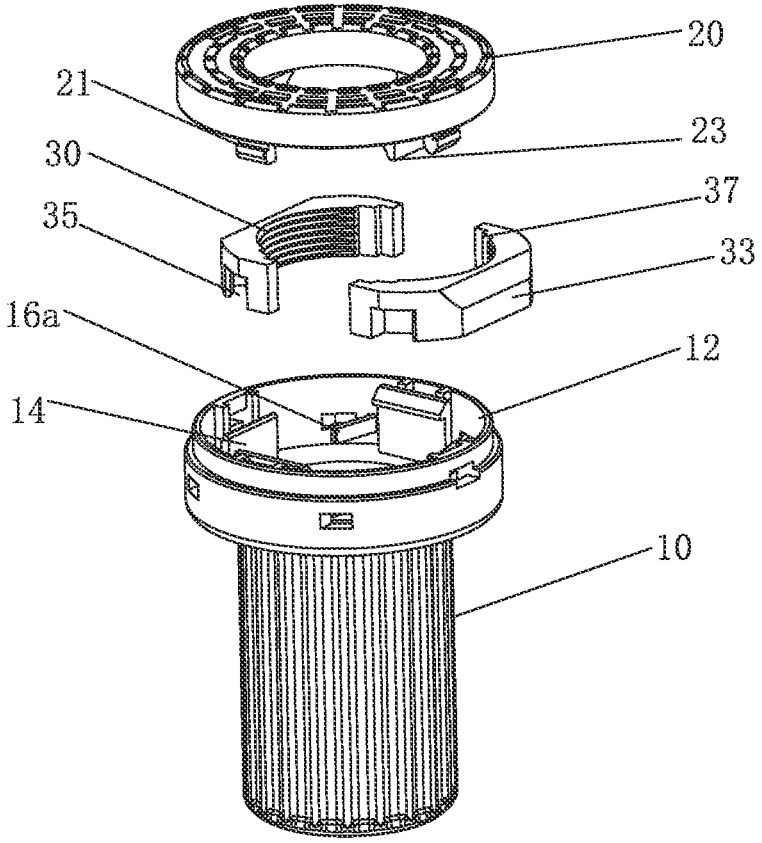
FIG. 2 illustrates an exploded view of FIG. 1.
Figure 3:
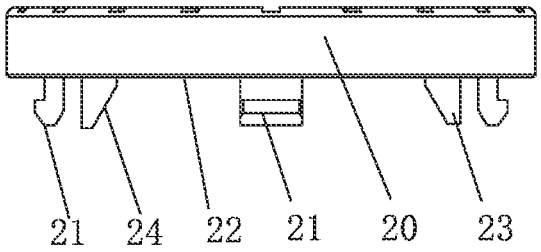
FIG. 3 illustrates a front view of an upper cover.
Figure 4:
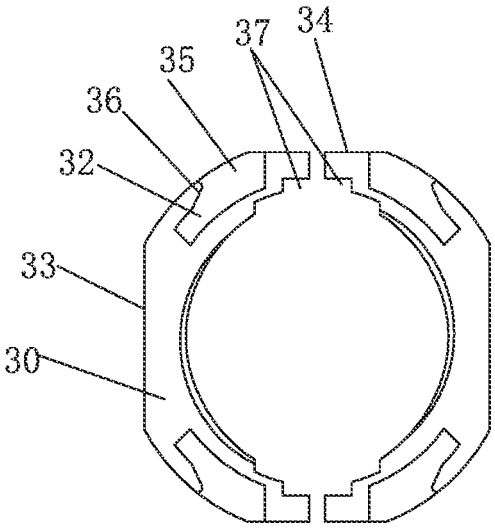
FIG. 4 illustrates a top view of at least two locking blocks.
Figure 5:
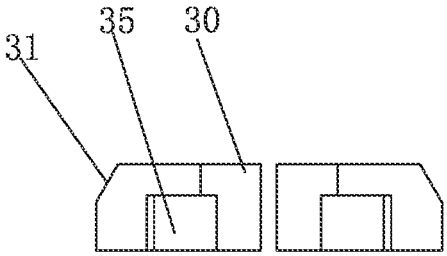
FIG. 5 illustrates a side view of the at least two locking blocks.
Figure 6:
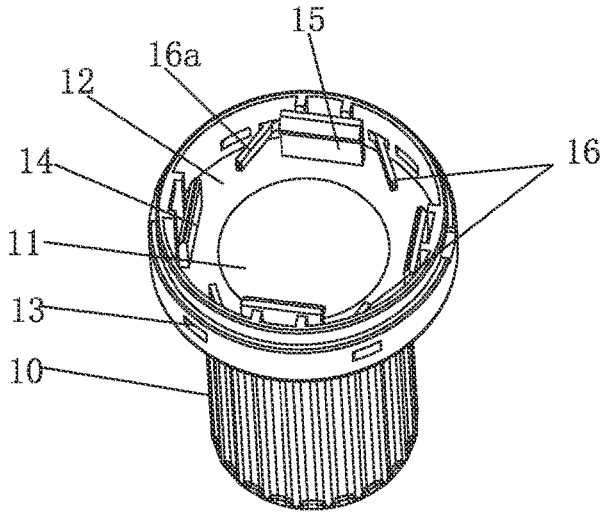
FIG. 6 illustrates a perspective view of a base seat.
Figure 7:
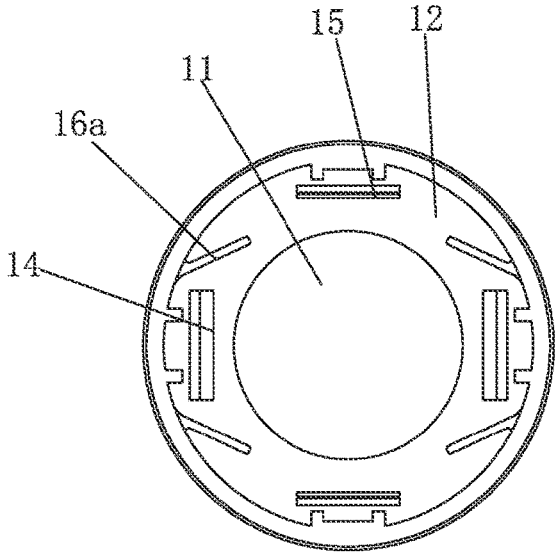
FIG. 7 illustrates a top view of the base seat.
Figure 8:
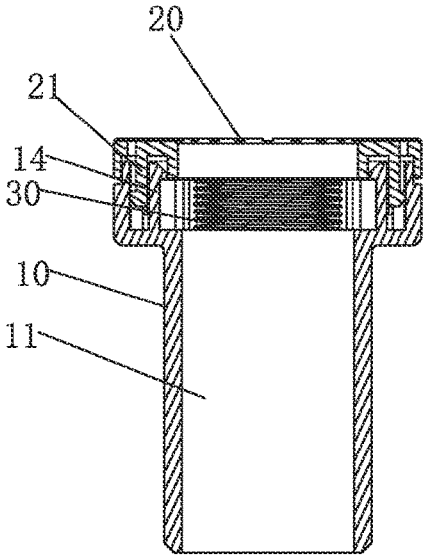
FIG. 8 illustrates a longitudinal cross-sectional view of the present disclosure.
Figure 9:
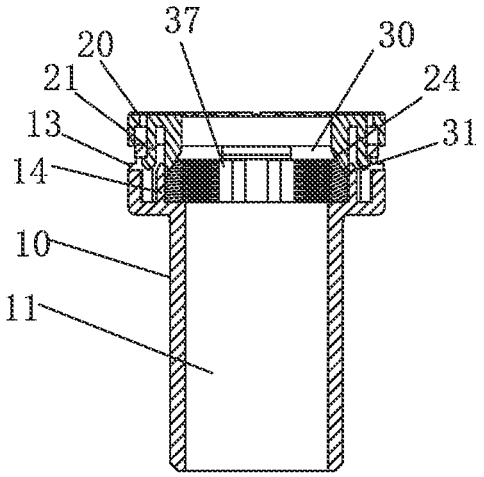
FIG. 9 illustrates a longitudinal cross-sectional view of the present disclosure (a faucet has been released).
Figure 10:
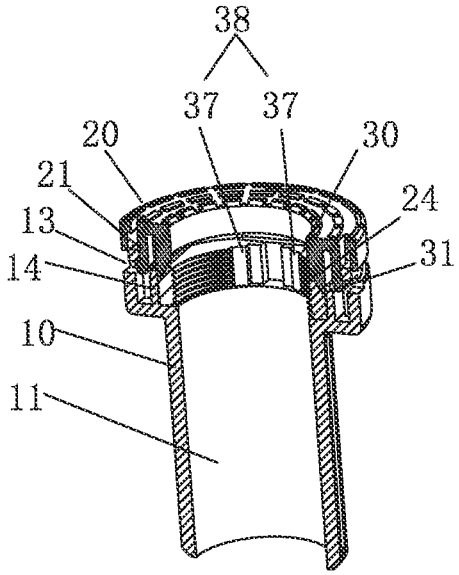
FIG. 10 illustrates a cross-sectional view of the present disclosure (the faucet has been released).
Figure 11:
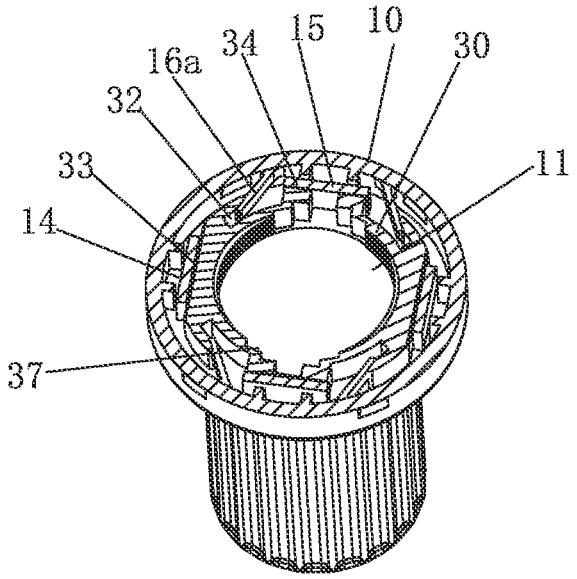
FIG. 11 illustrates a transverse cross-sectional view of the present disclosure (the faucet has been released).
Figure 12:
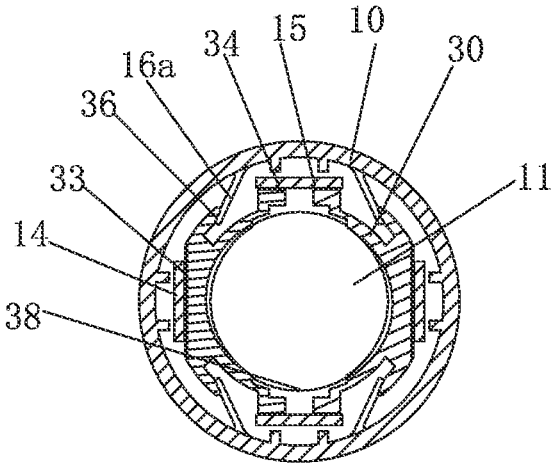
FIG. 12 illustrates a top view of FIG. 11 (the faucet has been released).
Figure 13:
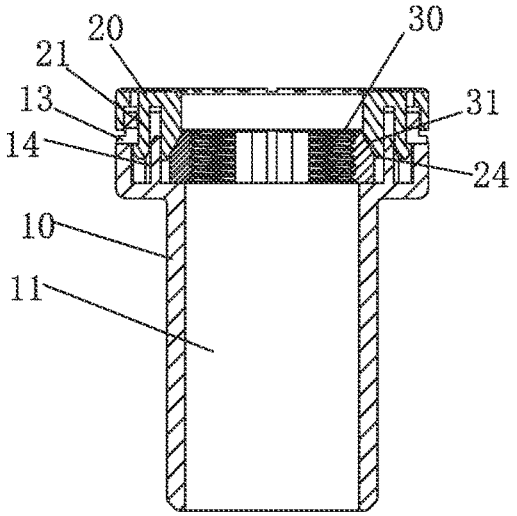
FIG. 13 illustrates a longitudinal cross-sectional view of the present disclosure (the faucet is clamped tightly).
Figure 14:
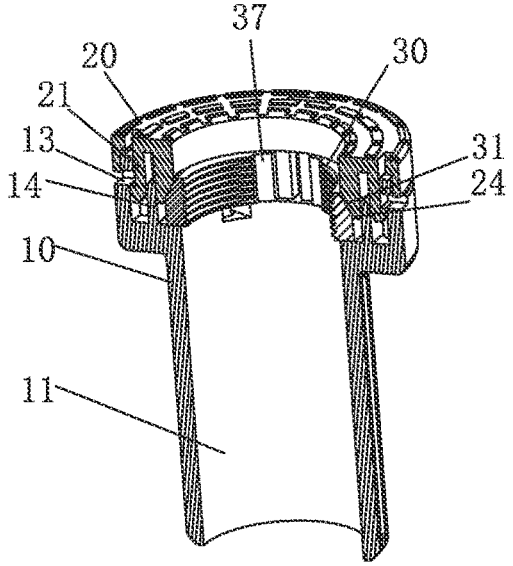
FIG. 14 illustrates a cross-sectional view of the present disclosure (the faucet is clamped tightly).
Figure 15:
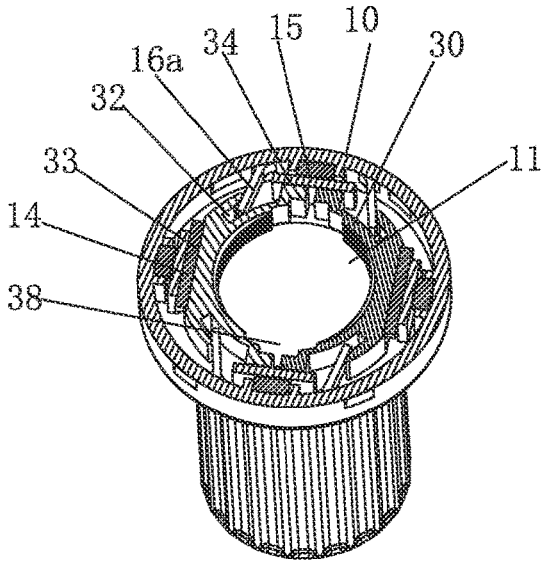
FIG. 15 illustrates a transverse cross-sectional view of the present disclosure (the faucet is clamped tightly)
Figure 16:
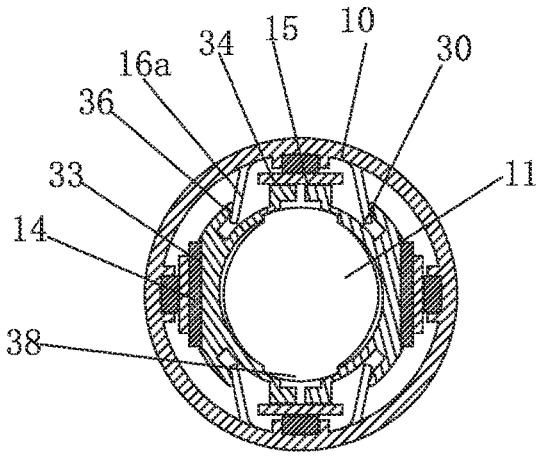
FIG. 16 illustrates a top view of FIG. 15 (the faucet is clamped tightly).

Wherein: 10 base seat, 11 mounting hole, 12 assembly groove, 13 first buckle member, 14 supporting member, 15 guiding member, 16 elastic assembly, 16*a* elastic member, 20 upper cover, 21 second buckle member, 22 blocking ring, 23 transmission member, 24 second inclined surface, 25 through hole, 30 locking block, 31 first inclined surface, 32 buckle groove, 33 supporting groove, 34 sliding surface, 35 opening, 36 guiding inclined surface, 37 notch, 38 position-providing notch, 40 gasket, 50 threaded tube, 60 countertop.

DETAILED DESCRIPTION OF THE EMBODIMENTS

The present disclosure will be further described below in combination with the accompanying drawings and embodiments.

The terms "first", "second", and similar terms used in the present disclosure do not denote any order, quantity, or importance in the present disclosure, but are used to distinguish one component from other components.

Some directional terms used to describe the drawings, such as "upper", "lower", "left", "right", "front", "rear", and other directional terms will be understood to have their normal meaning and refer to those directions involved in normal viewing of the drawings. Unless otherwise indicated, directional terms described herein substantially follow conventional directions as understood by those skilled in the art.

Referring to FIGS. 1 to 16, a quick assembly and quick disassembly device for a faucet configured for fastening of the faucet comprises a base seat 10, an upper cover 20, and at least two locking blocks 30. The base seat 10 comprises a mounting hole 11 penetrating therethrough along an axial direction of the base seat 10, and the mounting hole 11 is configured for passing a threaded tube and/or other components of the faucet therethrough. The base seat 10 is a sleeve tube, and a top portion of the base seat 10 comprises an assembly groove 12 that comprises a top opening. The at least two locking blocks 30 are disposed in the assembly groove 12, and the at least two locking blocks 30 comprise internal threads.

The upper cover 20 is sleeved outside of the faucet and is detachably connected to the base seat 10. That is, the upper cover 20 comprises a through hole 25 for passing through of the faucet. The detachable connection between the upper cover 20 and the base seat 10 can adopt a buckle connection. The base seat 10 comprises a first buckle member 13 located adjacent to a top portion of the base seat 10, and the first buckle member 13 is configured to be located on a side wall of the assembly groove 12. The upper cover 20 comprises a second buckle member 21 that cooperates with the first buckle member 13 to achieve the buckle connection through being locked to the first buckle member 13. The first buckle member 13 is one or more buckle holes, and the second buckle member 21 is one or more buckle strips. Or, the first buckle member 13 is one or more buckle strips, and the second buckle member 21 is one or more buckle holes.

Furthermore, an inner side of the upper cover 20 comprises a blocking ring 22, and the at least two locking blocks 30 are disposed between the blocking ring 22 and a bottom of the assembly groove 12 so as to inhibit movement of the at least two locking blocks 30 along the axial direction of the base seat 10. The blocking ring 22 defines a side wall of the through hole 25 and extends downwards along the axial direction of the base seat 10.

The at least two locking blocks 30 are spaced apart from one another along a circumferential direction of the mounting hole 11. Each of the at least two locking blocks 30 further comprises a first inclined surface 31 configured to be located on a top portion of an outside thereof and inclined upward along a radial direction of the base seat 10. The upper cover 20 correspondingly comprises at least two transmission members 23, and an inner side of the least two transmission members 23 comprises a second inclined surface 24 correspondingly matched with the first inclined surface 31. Each of the at least two transmission members 23 is configured to push the first inclined surface 31 of a corresponding one of the at least two locking blocks 30 to enable the corresponding one of the at least two locking blocks 30 to move inward along the radial direction of the base seat 10 to tightly abut the faucet.

Between two opposite ends of two adjacent locking blocks 30 of the at least two locking blocks 30, a gap is defined, so as to enable a threaded tube 50 of the faucet to easily pass through a hole defined by the at least two locking blocks 30. An inner side of each end of each of the at least two locking blocks 30 comprises a notch 37, and two of the notches 37 of the two adjacent locking blocks 30 define a position-providing notch 38 configured to provide a space for a joint of a flexible water inlet pipe to pass through. A number of the locking blocks 30 can be determined according to needs, which can be two, three, or even more, and preferably two.

An inner wall of the base seat 10 is disposed with at least two elastic assemblies 16, and a distal end of each of the at least two elastic assemblies 16 is inserted into a corresponding one of the at least two locking blocks 30 to enable the corresponding one of the at least two locking blocks 30 to move outward to release the faucet. Each of the at least two locking blocks 30 can comprise two buckle grooves 32 arranged symmetrically, and the two buckle grooves 32 extend along a circumferential direction of the at least two locking blocks 30. Each of the two buckle grooves 32 comprises an opening 35 located on an outer peripheral wall of the at least two locking blocks 30 and adjacent to a distal end of the at least two locking blocks 30, and a side of the opening 35 adjacent to the at least two locking blocks 30 comprises a guiding inclined surface 36 inclined outward. A number of the elastic assemblies 16 can be matched with a number of the locking blocks 30. Each of the at least two elastic assemblies 16 comprises two elastic members **16*a* arranged symmetrically, and each of the two elastic members 16*a* obliquely extends along the radial direction of the base seat 10 from a side wall of the assembly groove 12 toward the opening 35 of a corresponding one of the two buckle grooves 32. The two elastic members 16*a* can be rib-shaped. The two elastic members 16*a* arranged obliquely are capable of deformation, and when a distal end of each of the two elastic members 16*a* is inserted into a corresponding one of the two buckle grooves 32 and abuts the guiding inclined surface 36 in a contact manner, the two elastic members 16*a* drive a corresponding one of the at least two locking blocks 30 to move outward along the radial direction of the base seat 10** to release the faucet.

In the present disclosure, according to needs, each of the two elastic members **16*a* also can obliquely extend upward along the radial direction of the base seat 10 from a bottom surface of the assembly groove 12, and each of the two buckle grooves 32 can be correspondingly set as extending along the axial direction of the base seat 10. That is, the two buckle grooves 32 extend from a bottom surface of a corresponding one of the at least two locking blocks 30. The bottom surface and an outer side of each of the at least two locking blocks 30 comprise an opening for the distal end of each of the at least two elastic assemblies 16 to be inserted into, and a number and a position of the buckle grooves 32 and a number and a position of the two elastic members 16*a*** can be adjusted according to actual situations, and the disclosure is not limited in this regard.

Furthermore, the outer side of each of the at least two locking blocks 30 comprises a supporting surface 33 extending in a direction perpendicular to a moving direction of the at least two locking blocks 30. The assembly groove 12 is correspondingly disposed with a supporting member 14, and the supporting member 14 is matched with the supporting surface 33. The supporting surface 33 is located below the first inclined surface 31. The supporting surface 33 is set as a flat plane, and the supporting member 14 is correspondingly flat-board-shaped. Under an effect of the at least two elastic assemblies 16, the supporting surface 33 is configured to abut the supporting member 14 to have a position-limiting function. The supporting member 14 is configured to support the at least two transmission members 23 when the at least two transmission members 23 push the at least two locking blocks 30, which prevents the at least two transmission members 23 from deformation.

Furthermore, each of the at least two locking blocks 30 comprises a sliding surface 34, and the sliding surface 34 extends in a direction along the moving direction of the at least two locking blocks 30. The assembly groove 12 is correspondingly disposed with a guiding member 15, and the guiding member 15 is slidingly matched with the sliding surface 34. The sliding surface 34 can be formed on an outer side of each end of each of the at least two locking blocks 30, and the guiding member 15 can be disposed on the gap between the at least two locking blocks 30. When the at least two locking blocks 30 move inward or move outward in the radial direction of the base seat 10, the sliding surface 34 slides along the guiding member 15 so that the guiding member 15 has a guiding function.

In the present invention, the at least two locking blocks 30 can be made of high-temperature modified rigid plastic with strong rigidity, which ensures locking strength and stability. The base seat 10 and the upper cover 20 can be made of conventional plastic materials, such as common polyoxymethylene (POM) material, thereby reducing an overall cost, simplifying the structure, and making the assembly more convenient. In practical applications, the at least two locking blocks 30 can also be made of other conventional materials such as high-toughness plastic or metal material, but the disclosure is not limited in this regard.

Figure 17:
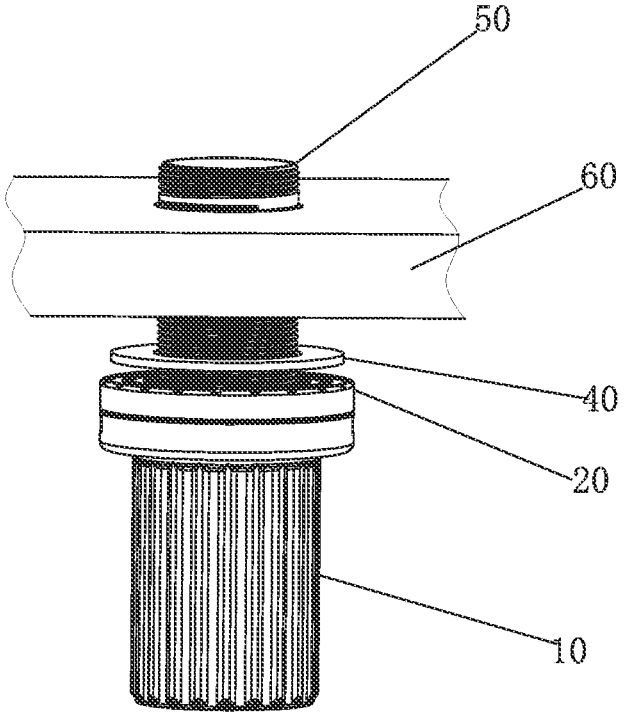
FIG. 17 illustrates a faucet assembly of the present disclosure.
Figure 18:
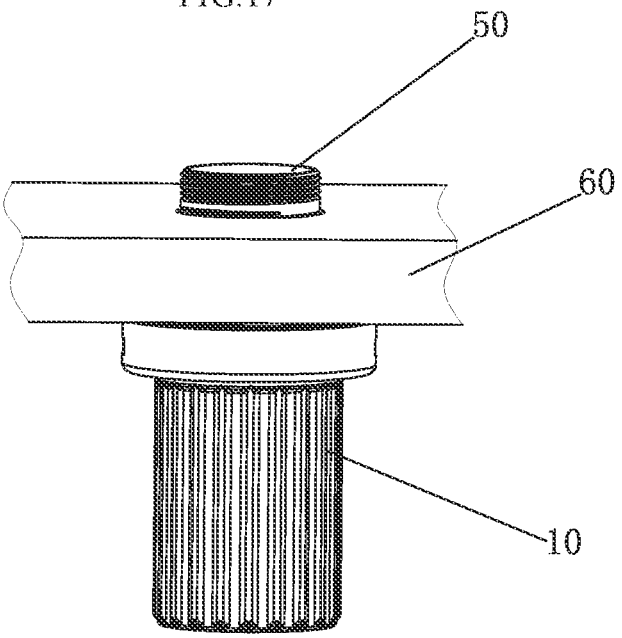
FIG. 18 illustrates a faucet assembly of the present disclosure (the faucet is clamped tightly).

Referring to FIG. 17, when installing the faucet under a countertop 60, firstly a gasket 40 and the base seat 10 with the upper cover 20 are sleeved on the threaded tube 50 of the faucet from bottom to top. At this time, the first buckle member 13 is buckled on the second buckle member 21. Due to an action of the at least two elastic assemblies 16, the at least two locking blocks 30 release the threaded tube 50, see FIGS. 9 to 12. A gap between an edge of a top of the upper cover 20 and a top surface of the base seat 10 is reduced, the first buckle member 13 can be separated from the second buckle member 21, and ends of the at least two transmission members 23 are squeezed between the supporting member 14 and the at least two locking blocks 30. The second inclined surface 24 pushes the first inclined surface 31 of a corresponding one of the at least two locking blocks 30, the at least two locking blocks 30 move radially inward to abut an entire end face of the threaded tube 50 of the faucet, the two elastic members 16*a* deform, and then the base seat 10 is rotated forward to achieve installation locking, see FIG. 13 to FIG. 16 and FIG. 18.

When detaching the faucet, the base seat 10 is rotated in an opposite direction, the upper cover 20 does not move, and the base seat 10 moves down. The gap between the edge of the top of the upper cover 20 and the top surface of the base seat 10 becomes larger, and the at least two elastic assemblies 16 are changed to an original position to drive the at least two locking blocks 30 to move radially outward to release the faucet. Then the base seat 10 is removed from the threaded tube 50 for quick disassembly.

In the present disclosure, there is the gap between the edge of the top of the upper cover 20 and the top surface of the base seat 10. When the at least two locking blocks 30 tightly abut the threaded tube 50 of the faucet, the gap allows the at least two locking blocks 30 to lock the threaded tube 50 of the faucet with different threads. A locking height of the base seat 10 can be adjusted according to a thread size of the threaded tube 50. For example, when locking a M33 thread, the gap between the edge of the top of the upper cover 20 and the top surface of the base seat 10 is relatively large. When locking a M32 thread, there is no gap between the edge of the top of the upper cover 20 and the top surfaces of the base seat 10.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. An assembly and disassembly device for a faucet, configured for fastening of the faucet, comprising:
- a base seat,
- an upper cover, and
- at least two locking blocks, wherein:
  - the base seat comprises a mounting hole configured for passing through of the faucet,
  - the upper cover is configured to be sleeved outside of the faucet and is detachably connected to the base seat,
  - the at least two locking blocks are disposed in the base seat and spaced apart from one another along a circumferential direction of the mounting hole,
  - each of the at least two locking blocks comprises a first inclined surface,
  - the upper cover correspondingly comprises at least two transmission members configured to push the first inclined surface of a corresponding one of the at least two locking blocks to enable the corresponding one of the at least two locking blocks to move inward along a radial direction of the base seat to abut the faucet,
  - an inner wall of the base seat is disposed with at least two elastic assemblies obliquely extending along the radial direction of the base seat, and
  - a distal end of each of the at least two elastic assemblies is disposed in the corresponding one of the at least two locking blocks to enable the corresponding one of the at least two locking blocks to move outward to release the faucet.

2. The assembly and disassembly device for the faucet according to claim 1, wherein:
- each of the at least two locking blocks comprises two buckle grooves arranged symmetrically,
- the two buckle grooves extend along a circumferential direction or a radial direction of the at least two locking blocks,
- each of the at least two elastic assemblies comprises two elastic members arranged symmetrically, and
- a distal end of each of the two elastic members is disposed in a corresponding one of the two buckle grooves.

3. The assembly and disassembly device for the faucet according to claim 2, wherein:
- each of the two buckle grooves comprises an opening located on an outer peripheral wall of the at least two locking blocks and adjacent to a distal end of the at least two locking blocks, and a side of the opening comprises a guiding inclined surface inclined outward.

4. The assembly and disassembly device for the faucet according to claim 1, wherein:

a top portion of the base seat comprises an assembly groove, the at least two locking blocks are disposed in the assembly groove, and the at least two elastic assemblies are disposed on a side wall of the assembly groove.

5. The assembly and disassembly device for the faucet according to claim 4, wherein:

an outer side of each of the at least two locking blocks comprises a supporting surface extending in a direction perpendicular to a moving direction of the at least two locking blocks, the assembly groove is correspondingly disposed with a supporting member, and the supporting member is matched with the supporting surface.

6. The assembly and disassembly device for the faucet according to claim 4, wherein:

each of the at least two locking blocks comprises a sliding surface, the sliding surface extends in a direction along a moving direction of the at least two locking blocks, the assembly groove is correspondingly disposed with a guiding member, and the guiding member is slidingly matched with the sliding surface.

7. The assembly and disassembly device for the faucet according to claim 4, wherein:

the upper cover comprises a blocking ring, and the at least two locking blocks are disposed between the blocking ring and a bottom of the assembly groove.

8. The assembly and disassembly device for the faucet according to claim 1, wherein:

an inner side of each end of each of the at least two locking blocks comprises a notch, and two of the notches of two adjacent locking blocks of the at least two locking blocks define a position-providing notch, or the at least two locking blocks are made of plastic.

9. The assembly and disassembly device for the faucet according to claim 1, wherein:

the base seat comprises a first buckle member located adjacent to a top portion of the base seat, and the upper cover comprises a second buckle member that cooperates with the first buckle member to achieve a detachable connection through being locked to the first buckle member.

10. The assembly and disassembly device for the faucet according to claim 1, wherein:

the first inclined surface is configured to be located on a top portion of an outside of the at least two locking blocks and inclined upward along the radial direction of the base seat, and an inner side of the least two transmission members comprises a second inclined surface correspondingly matched with the first inclined surface.

* * * * *